United States Patent [19]

Cheung et al.

[11] Patent Number: 5,069,698

[45] Date of Patent: Dec. 3, 1991

[54] XENON PRODUCTION SYSTEM

[75] Inventors: Harry Cheung; Michael R. Couche, both of Williamsville; James R. Dray, Kenmore, all of N.Y.

[73] Assignee: Union Carbide Industrial Gases Technology Corporation, Danbury, Conn.

[21] Appl. No.: 609,624

[22] Filed: Nov. 6, 1990

[51] Int. Cl.[5] ..... F25J 3/04

[52] U.S. Cl. ..... 62/22; 55/66

[58] Field of Search ..... 62/22; 55/66

[56] References Cited

U.S. PATENT DOCUMENTS

| | | | |
|---|---|---|---|
| 2,793,511 | 5/1957 | Bonnaud | 62/22 |
| 3,222,879 | 12/1965 | Stoklosinski | 62/22 |
| 3,596,471 | 8/1971 | Streich | 62/22 |
| 3,609,983 | 10/1971 | Lofredo et al. | 62/22 |
| 3,751,934 | 8/1973 | Frischbier | 62/41 |
| 3,768,270 | 10/1973 | Schuftan | 62/31 |
| 3,779,028 | 12/1973 | Schuftan et al. | 62/22 |
| 4,384,876 | 5/1983 | Mori et al. | 62/22 |
| 4,401,448 | 8/1983 | LaClair | 62/22 |
| 4,421,536 | 12/1983 | Mori et al. | 62/18 |
| 4,568,528 | 2/1986 | Cheung | 423/262 |
| 4,574,006 | 3/1986 | Cheung | 62/22 |
| 4,647,299 | 3/1987 | Cheung | 62/22 |
| 4,805,412 | 2/1989 | Colley et al. | 62/22 |

*Primary Examiner*—Ronald C. Capossela

*Attorney, Agent, or Firm*—Stanley Ktorides

[57] ABSTRACT

Method and apparatus for improving xenon recovery wherein a liquid containing krypton and xenon is removed from a cryogenic rectification facility at a defined flowrate which selectively improves xenon recovery and is provided into a facility having rare gas production capability.

19 Claims, 6 Drawing Sheets

XENON PRODUCTION SYSTEM

TECHNICAL FIELD

This invention relates generally to the field of cryogenic rectification and more particularly to the production of rare gases by cryogenic rectification.

BACKGROUND ART

The rare gases, krypton and xenon, are finding increasing application in industrial and other uses. Krypton is being widely used in high quality lighting including long-life light bulbs and automotive lamps. Xenon is being used for medical applications, including special x-ray equipment. Both gases are commonly used in many laboratory and research applications. The source of krypton and xenon is the atmospheric air which contains 1.14 ppm krypton and 0.087 ppm xenon for a krypton to xenon ratio of 13:1. During air separation processes that involve the cryogenic separation of the air, the krypton-xenon tends to concentrate with the oxygen product. Accordingly, the primary source of krypton-xenon is from air separation plants and involves further processing of the oxygen product to recover the krypton-xenon content. Examples of recent advances in such krypton-xenon recovery processes may be found in U.S. Pat. No. 4,401,448—La Clair, U.S. Pat. No. 4,568,528—Cheung and U.S. Pat. No. 4,574,006—Cheung.

Because most of the krypton and xenon in the air is recovered and further processed, the krypton product to xenon product ratio is about the same as their composition ratio in the atmospheric air, i.e. about 13:1. However, the demand for xenon is presently increasing at a faster rate than that for krypton primarily because of the rate of xenon application in the medical field. Xenon is a major portion of the fill gas in detectors used with computerized axial tomography (CAT) scanners and is also used as part of a breathing mixture for patients undergoing a CAT scan. Accordingly it is desirable to lower the krypton-xenon ratio of the recovered rare gases by enhancing the production of xenon produced by cryogenic rectification.

It is an object of this invention to provide a method for enhancing the production of xenon produced by cryogenic rectification of a mixture containing krypton and xenon.

It is another object of this invention to provide apparatus useful for enhancing the production of xenon produced by cryogenic rectification of a mixture containing krypton and xenon.

SUMMARY OF THE INVENTION

The above and other objects which will become apparent to one skilled in the art upon a reading of this disclosure are attained by the present invention one aspect of which is:

A method for enhancing the production of xenon comprising:

(A) separating a mixture containing krypton, xenon and oxygen in a cryogenic rectification system and producing gaseous oxygen product and liquid containing krypton and xenon in equilibrium with the gaseous oxygen product;

(B) removing gaseous oxygen product from the cryogenic rectification system and removing liquid containing krypton and xenon from the cryogenic rectification system at a molar flowrate no more than 5 percent of the molar flowrate at which the gaseous oxygen product is removed; and (C) providing liquid removed from the cryogenic rectification system in step (B) into a facility having rare gas production capability.

Another aspect of the invention comprises:

Apparatus for enhancing the production of xenon comprising:

(A) a cryogenic rectification system for producing a gaseous oxygen product and in equilibrium therewith a liquid containing krypton and xenon;

(B) means to remove liquid containing krypton and xenon at a controlled flowrate from the cryogenic rectification system; and (C) means to provide liquid removed from the cryogenic rectification system at the controlled flowrate into a facility having rare gas production capability.

The term, "column", as used in the present specification and claims means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column and/or on packing elements. For a further discussion of distillation columns see the Chemical Engineers' Handbook. Fifth Edition, edited by R. H. Perry and C. H. Chilton, McGraw-Hill Book Company, New York, Section 13, "Distillation" B. D. Smith et al, page 13-3, *The Continuous Distillation Process.* The term double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns.

As used herein the term "cryogenic rectification system" means an apparatus for carrying out vapor liquid countercurrent separation at a temperature below about 120° K. and comprising at least one column.

As used herein the term "gaseous oxygen product" means a fluid having an oxygen concentration of at least 95 percent taken from a cryogenic rectification system.

As used herein the term "in equilibrium" means a condition wherein liquid and vapor phases are in thermodynamic equilibrium. When liquid and vapor phases are in equilibrium at given conditions of pressure and temperature, the phase compositions do not change with time.

As used herein the term "facility having rare gas production capability" means a cryogenic rectification system which can produce a fluid containing krypton and xenon in a concentration greater than their concentration in air. The krypton and xenon may be in gaseous, liquid or mixed phase form. Examples of a facility having rare gas production capability are found in U.S. Pat. No. 4,401,448—La Clair, U.S. Pat. No. 4,568,528—Cheung and U.S. Pat. No. 4,574,006—Cheung, each of which are incorporated herein by reference.

As used herein the term "air separation plant" means a cryogenic rectification system wherein air is a feed.

DETAILED DESCRIPTION

The invention will have particular utility when used in conjunction with the cryogenic rectification of air and will be described in detail with reference to the drawings wherein the cryogenic rectification system and the facility having rare gas production capability are each air separation plants.

Figure 1:
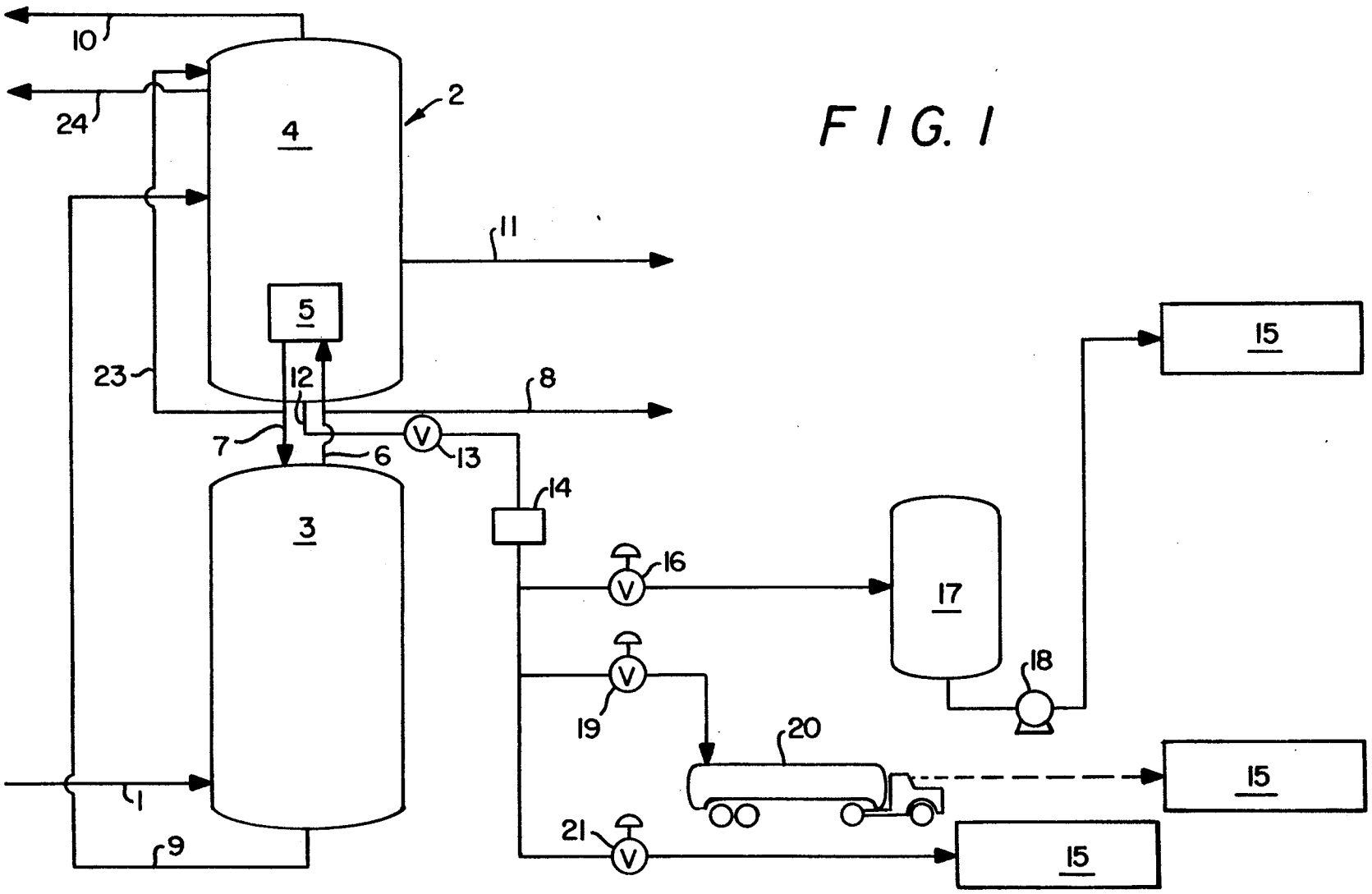
FIG. 1 is a simplified schematic representation of one embodiment of a cryogenic rectification system useful with this invention.

Referring now to FIG. 1, feed air 1 comprising oxygen, krypton and xenon is provided into cryogenic rectification system 2 which comprises a double column comprising higher pressure column 3, generally operating within the range of from 65 to 160 pounds per square inch absolute (psia), and lower pressure column 4, generally operating within the range of from 14 to 55 psia. The columns are in heat exchange relation at main condenser 5. In the preferred practice of this invention the cryogenic rectification system comprises a double column arrangement.

Within column 3 the feed air undergoes a preliminary separation by cryogenic rectification into nitrogen enriched vapor and oxygen enriched liquid. Nitrogen enriched vapor 6 is passed into main condenser 5 and condensed by indirect heat exchange with column 4 bottoms. Condensed stream 7 is returned to column 3 as reflux. A portion 23 of condensed stream 7 is passed into column 4 as reflux. A portion 8 of the nitrogen enriched vapor may be passed through an expansion turbine to generate refrigeration. Oxygen-enriched liquid 9 is passed from column 3 into column 4 wherein it undergoes separation by cryogenic rectification into nitrogen and oxygen. Nitrogen is removed from column 4 in stream 10 and may be recovered as nitrogen product. A nitrogen waste stream 24 is removed from column 4 near the top of the column. Oxygen passes into the bottom of column 4 where it is reboiled by the aforesaid indirect heat exchange with nitrogen enriched vapor at the main condenser to produce an oxygen-containing vapor and an oxygen-containing liquid which are in equilibrium.

Because the vapor pressures of krypton and xenon are both less than that of oxygen, which in turn has a lesser vapor pressure than that of nitrogen, essentially all of the krypton and xenon in the feed air goes with the oxygen and resides in the oxygen-containing liquid at the bottom of column 4 in the same ratio as they are found in the feed air, i.e. 13 to 1 krypton to xenon. A steady state would be reached when the quantity of krypton and xenon leaving with the gaseous oxygen production is the same as that entering in the feed air. The invention comprises a system which enables one to lower this ratio and thus effectively produce xenon without collecting as much of the feed air krypton by creating a new steady state which includes liquid drainage flow.

Referring back to FIG. 1, oxygen containing vapor is removed from column 4 as gaseous oxygen product 11 and recovered. Generally the oxygen containing product is removed from the cryogenic rectification system at a flowrate within the range of from about 18 to 24 percent of the molar flowrate of the feed air. Liquid containing krypton and xenon which is in equilibrium with the gaseous oxygen product is removed from column 4 in stream 12 at a molar flowrate no more than 5 percent of the molar flowrate at which the gaseous oxygen product 11 is removed, preferably at a molar flowrate within the range of from 0.1 to 3.5 percent, and most preferably at a molar flowrate within the range of from 0.5 to 2.5 percent. Most preferably, as illustrated in FIG. 1, both the oxygen product removal and the liquid containing krypton and xenon are removed from the cryogenic rectification system at the area of the main condenser. As indicated, these two fluids are in equilibrium. In practice, there is slight liquid mist entrainment in addition to usual phase equilibrium similar to that which occurs on distillation trays. However, the system, as usually taken in total, is in equilibrium or steady state.

The liquid removed from column 4 at the defined flowrate is then passed into a facility having rare gas production capability either directly or through one or more intermediary steps. Liquid 12 is passed in a conduit through valve 13 and flow measurement device 14 which serve to maintain the flowrate of stream 12 at the desired rate. For example flow measurement device 14 may be an orifice which provides a pressure drop signal to control valve 13.

FIG. 1 illustrates three different ways that liquid 2 may be provided into the facility having rare gas production capability 15. For example, liquid 12 may be passed through valve 16 into collection or holding tank 17 and then, as desired, pumped by pump 18 into facility 15. Alternatively, liquid 12 may be passed through valve 19 into tanker truck 20, trucked to facility 15 and then pumped into the facility. A third possibility in the direct passage of liquid 12 through valve 21 into facility 15.

Figure 2:
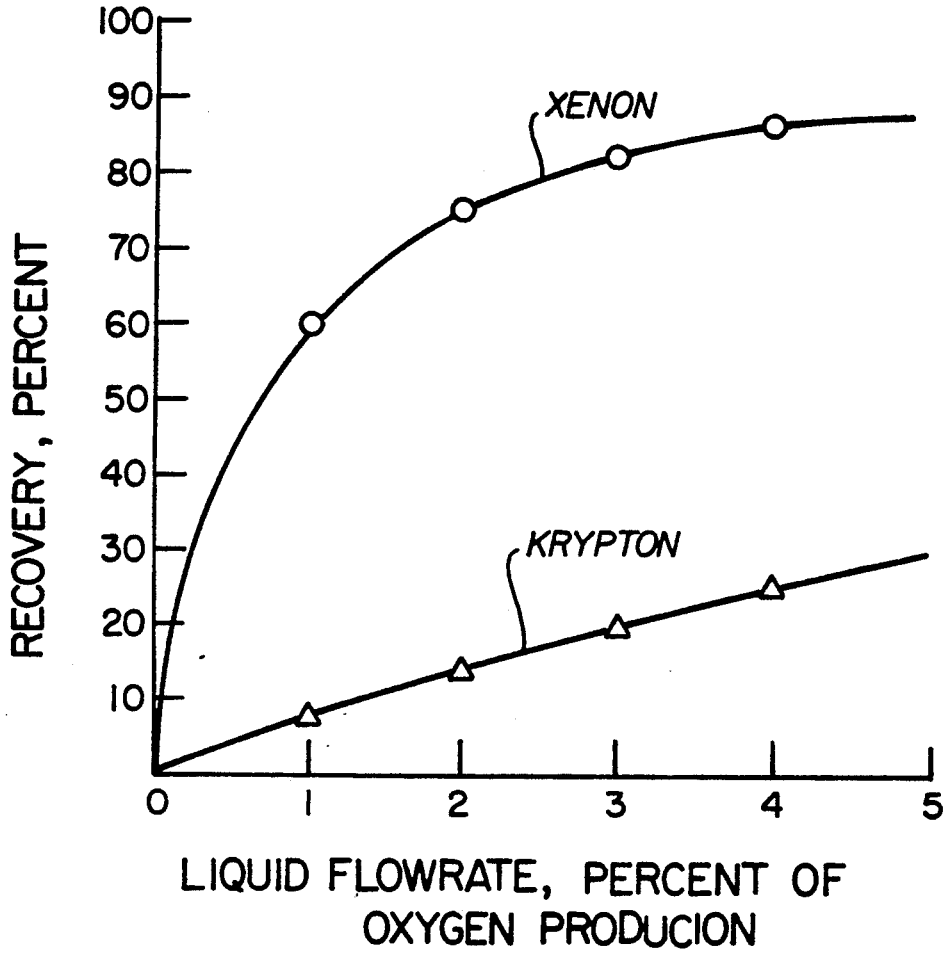
FIG. 2 is a graphical representation of xenon and krypton recovery as a function of liquid flowrate at a percentage of oxygen production.
Figure 3:
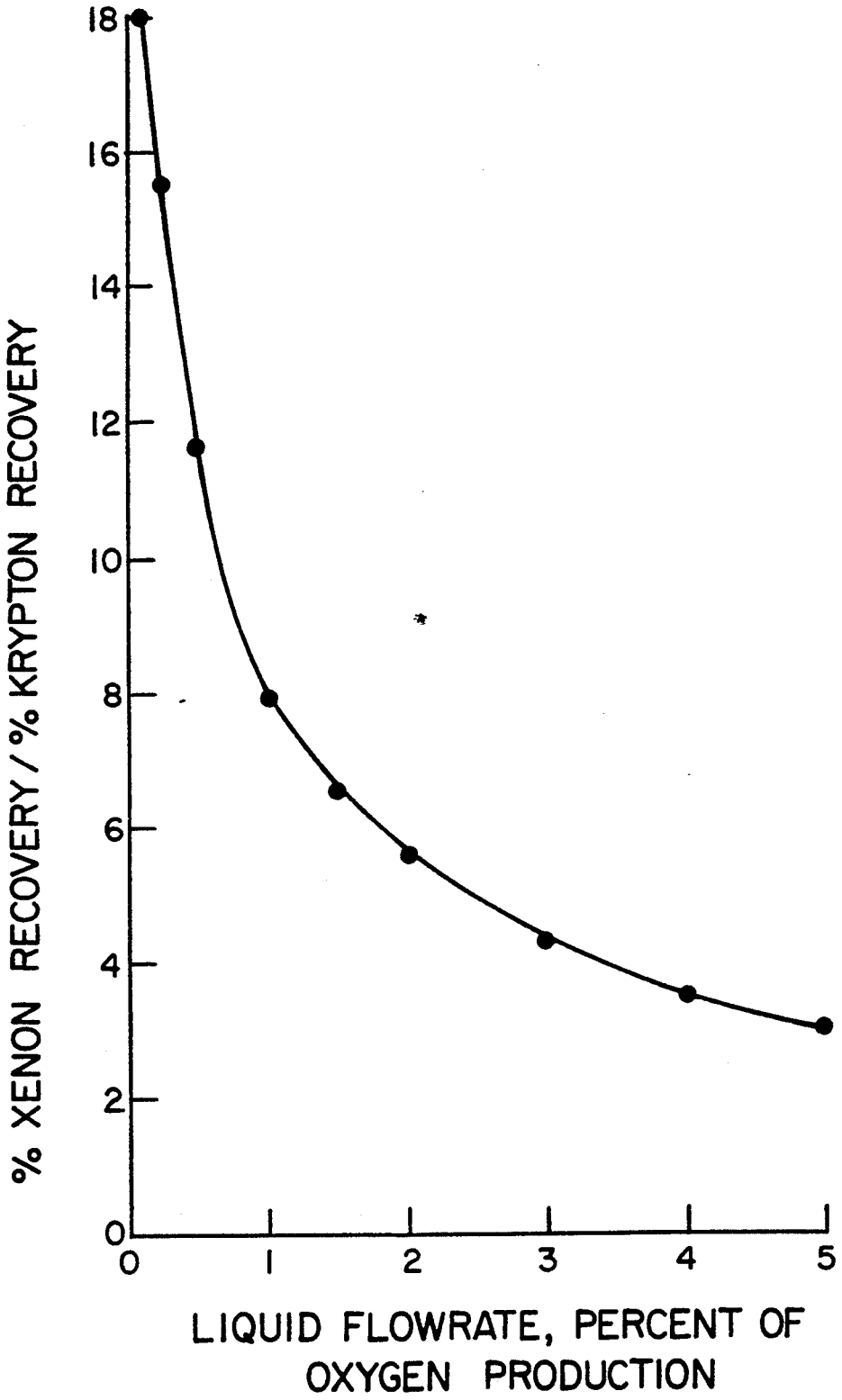
FIG. 3 is a graphical representation of the ratio of xenon to krypton recovery as a function of liquid flowrate as a percentage of oxygen production.
Figure 4:
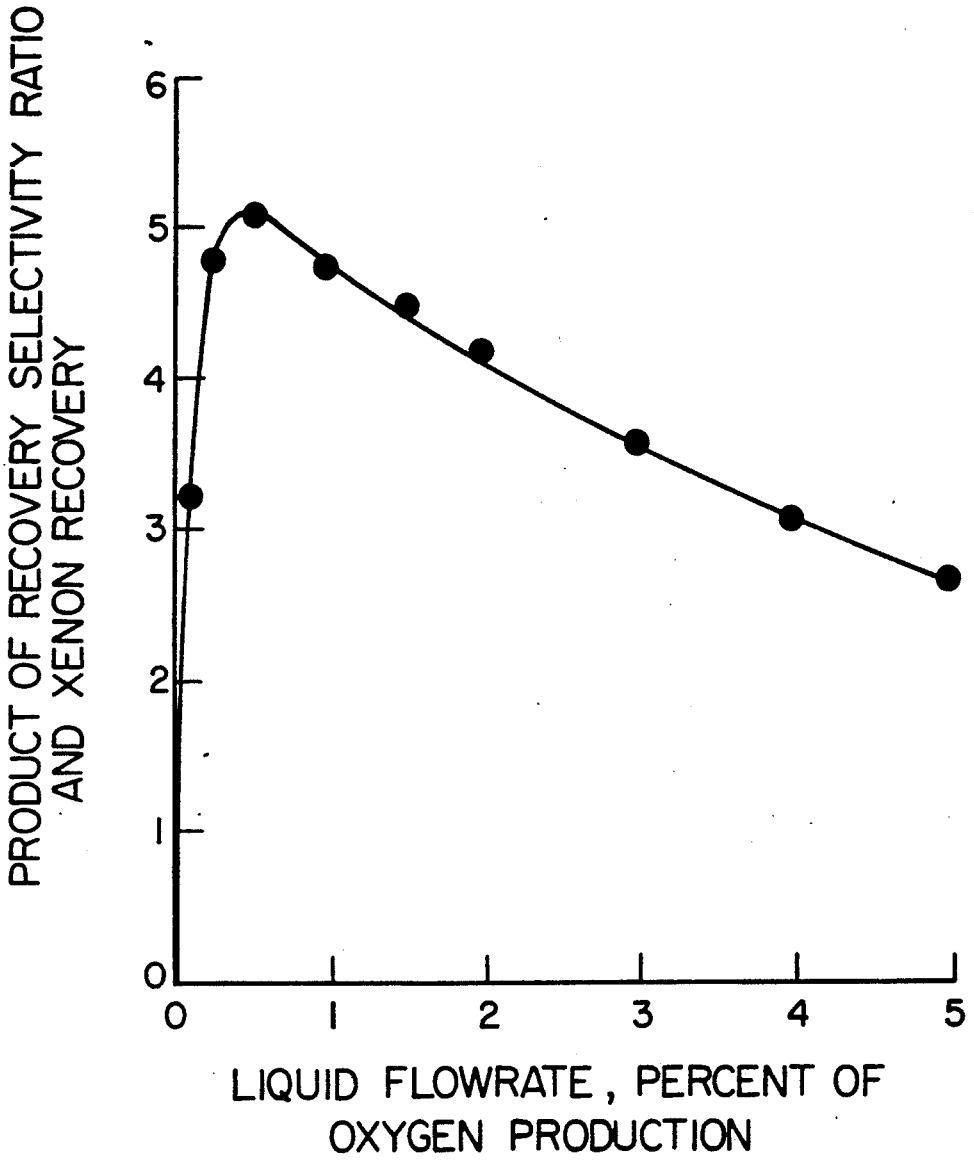
FIG. 4 is a graphical representation of the xenon recovery curve multiplied by the ratio of xenon to krypton recovery to demonstrate the range of optimum liquid flowrate for the best selective recovery of xenon.

The importance of the defined flowrate will be explained with reference to FIGS. 2–4. Employing a cryogenic rectification system similar to that illustrated in FIG. 1, calculations were made at liquid removal molar flowrates of 1, 2, 3, and 4 percent of the gaseous oxygen product removal molar flowrate. In each case the xenon and krypton recoveries were determined as a percentage of the xenon or krypton available for recovery in the bottom liquid and the results are graphically illustrated in FIG. 2. Using results from the curves generated by the data in FIG. 2, the ratio of xenon to krypton recovery, or selectivity ratio, was calculated for a number of flowrates up to 5 percent and illustrated graphically in FIG. 3. The product of the selectivity ratio and the xenon recovery is presented graphically in FIG. 4. As can be seen from the data presented in FIGS. 2–4, xenon recovery is quite high at low liquid removal flowrates and begins to level off at about a 5 percent flowrate. At flowrates greater than this there is little incremental xenon recovery while krypton recovery increases at a relatively constant rate. For example, at a liquid flowrate of 2 percent of the gaseous oxygen product flowrate, 75 percent of the xenon and only 13 percent of the krypton in the feed air are removed and passed on to the facility having rare gas production capability.

The cryogenic rectification system is a gaseous oxygen plant such that krypton and xenon collect in the oxygen side of the main condenser. They both have low volatility; however, the volatility of xenon is much lower than that of krypton. Therefore, they have a significant relative volatility such that xenon can be separated in the liquid phase in more concentrated form than in the vapor phase to a greater degree than can krypton. In the limit, when the drain rate is 100 percent, almost all the xenon and krypton would be in the liquid phase at the 13 to 1 ratio of krypton to xenon. By draining slowly, both krypton and xenon build up in concentration in the liquid in the main condenser. Since the xenon is almost non-volatile, little can leave in the oxygen vapor. However, the krypton has sufficient volatility to escape into the vapor at its steady state build up composition, thus enabling the attainment of the different recovery ratios.

At a liquid removal rate of about 2 percent or less additional refrigeration is generally not required for the cryogenic rectification facility. At liquid removal rates exceeding about 2 percent, some additional refrigeration, such as the addition of liquid cryogen, may be necessary to compensate for the refrigeration lost with the removal of the liquid. One advantageous arrangement for the provision of additional refrigeration utilizes liquid exchange between the facility having rare gas production capability and the cryogenic rectification system. Since liquid is being added to the rare gas production facility, corresponding liquid may be drained from this facility and passed into the cryogenic rectification system to balance the refrigeration between the two plants. For example, oxygen-enriched liquid from the rare gas production facility may be combined with oxygen-enriched liquid stream 9 of the cryogenic rectification system illustrated in FIG. 1.

Figure 5:
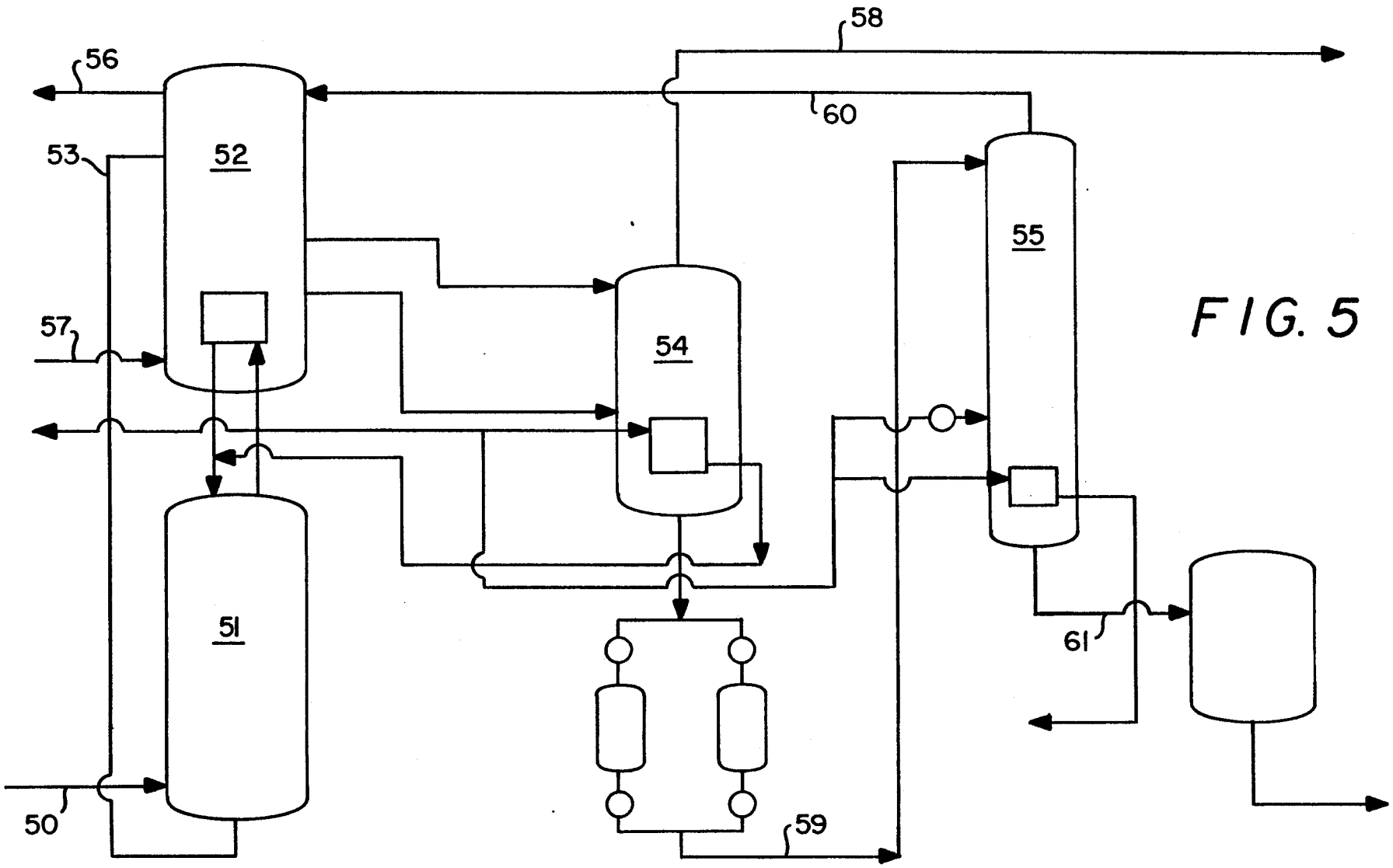
FIG. 5 is a simplified schematic representation of one embodiment of a facility having rare gas production capability useful in the practice of this invention.

FIG. 5 illustrates a simplified version of one facility having rare gas production capability which is useful in the practice of this invention. The facility illustrated in FIG. 5 is a double column cryogenic air separation plant further comprising a stripping column and an exchange column, and is similar to the facility disclosed in U.S. Pat. No. 4,401,448—La Clair. Feed air 50 is separated into oxygen-enriched liquid and nitrogen enriched vapor in higher pressure column 51. The oxygen enriched liquid 53 is provided into lower pressure column 52 wherein it is separated into nitrogen and oxygen. The nitrogen enriched vapor is used to reboil the bottoms of column 52 as well as the bottoms of stripping column 54 and exchange column 55. Nitrogen 56 is removed and recovered from column 52. The krypton and xenon in the feed air are essentially all in the liquid oxygen at the bottom of column 52. In the practice of this invention the liquid containing krypton and xenon which was removed at the defined flowrate from the cryogenic rectification system is provided into the facility having rare gas production capability, such as into the bottom of column 52 as illustrated in FIG. 5 by stream 57. Liquid oxygen is passed into the top of striping column 54 and gaseous oxygen is passed into the bottom of column 54, wherein they are passed against each other and the rare gases are stripped into the column 54 bottoms. Product oxygen is recovered as stream 58. The bottom liquid containing the krypton and xenon is filtered and passed 59 into the top of exchange column 55 wherein the krypton and xenon is exchanged with upflowing nitrogen which is passed 60 into column 52. The resulting liquid containing a concentration of krypton and xenon is recovered 61. In conventional practice the ratio of krypton and xenon in a crude rate gas product would be about the same as that in atmospheric air. With the practice of this invention, the concentration of xenon in the rare gas product, e.g. stream 61, from the facility having rare gas production capability is significantly higher than with conventional practice, thus enhancing the production of xenon.

Figure 6:
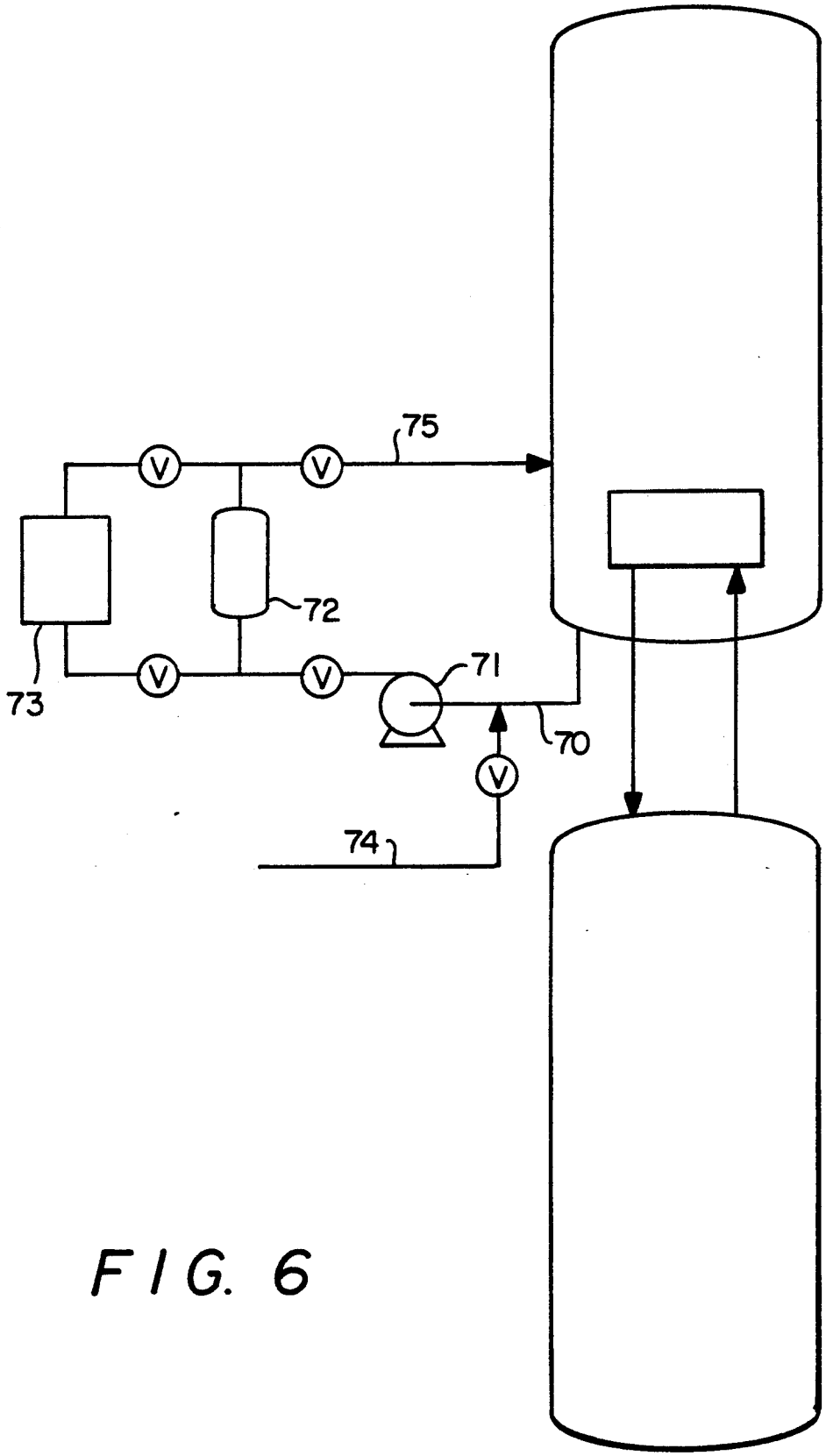
FIG. 6 is a schematic representation of one preferred method of providing liquid removed from the cryogenic rectification system into a facility having rare gas production capability.

FIG. 6 illustrates one convenient location for providing a xenon-enriched liquid taken from the cryogenic rectification system into the facility having rare gas production capability. In a double column air separation plant, liquid oxygen is removed 70 from the bottom of the lower pressure column and passed by pump 71 through a circuit containing a gel trap 72 and regeneration heater 73 and then returned 75 to the lower pressure column. This circuit is common in oxygen plants as a secondary safety precaution to remove any hydrocarbons from the system. Liquid removed from the cryogenic rectification system may be provided 74 into stream 70 upstream of the gel trap. Thus the liquid undergoes the benefit of the cleaning and is passed into the facility having rare gas production capability with stream 75.

Now by the use of this invention, one can easily and effectively enhance the production of xenon. Although the invention has been described with reference to certain embodiments, those skilled in the art will recognize that there are other embodiments of the invention within the spirit and the scope of the claims.

We claim:

1. A method for enhancing the production of xenon comprising:

(A) separating a mixture containing krypton, xenon and oxygen in a first cryogenic rectification system and producing gaseous oxygen product and liquid containing krypton and xenon in equilibrium with the gaseous oxygen product;

(B) removing gaseous oxygen product from the first cryogenic rectification system and removing liquid containing krypton and xenon from the first cryogenic rectification system at a molar flowrate no more than 5 percent of the molar flowrate at which the gaseous oxygen product is removed and having a ratio of krypton to xenon in the liquid removed from said first cryogenic rectification system less than that of said mixture containing krypton, xenon and oxygen; and (C) providing liquid removed from the first cryogenic rectification system in step (B) into a second cryogenic rectification system which can produce a fluid containing krypton and xenon in a concentration greater than their concentration in air.

2. The method of claim 1 wherein the liquid containing krypton and xenon is removed from the first cryogenic rectification system at a molar flowrate within the range of from 0.1 to 3.5 percent of the molar flowrate at which gaseous oxygen product is removed.

3. The method of claim 1 wherein the liquid containing krypton and xenon is removed from the first cryogenic rectification system at a molar flowrate within the range of from 0.5 to 2.5 percent of the molar flowrate at which the gaseous oxygen product is removed.

4. The method of claim 1 wherein the mixture containing krypton, xenon and oxygen separated in the cryogenic rectification system is air.

5. The method of claim 1 wherein the liquid removed from the first cryogenic rectification system is passed into collection means and from there provided into the second cryogenic rectification system.

6. The method of claim 1 wherein the liquid removed from the first cryogenic rectification system is trucked to the second cryogenic rectification system.

7. The method of claim 1 wherein the liquid removed from the first cryogenic rectification system is piped directly into the second cryogenic rectification system.

8. The method of claim 1 further comprising providing liquid from the second cryogenic rectification system into the first cryogenic rectification system.

9. Apparatus for enhancing the production of xenon comprising:

(A) a first cryogenic rectification system for producing a gaseous oxygen product and in equilibrium therewith a liquid containing krypton and xenon and means for providing a mixture comprising krypton, xenon and oxygen into the first cryogenic rectification system;

(B) means to remove liquid containing krypton and xenon at a controlled flowrate from the first cryogenic rectification system having a ratio of krypton to xenon in the liquid removed from said first cryogenic rectification system less than that of said mixture containing krypton, xenon and oxygen; and (C) means to provide liquid removed from the first cryogenic rectification system at the controlled flowrate into a second cryogenic rectification system which can produce a fluid containing krypton and xenon in a concentration greater than their concentration in air.

10. The apparatus of claim 9 wherein the means to remove liquid at a controlled flowrate comprises a conduit, a valve on the conduit and a flow measurement device which controls the valve.

11. The apparatus of claim 10 wherein the flow measurement device is an orifice which provides a pressure drop signal to control the valve.

12. The apparatus of claim 9 wherein the first cryogenic rectification system comprises a double column air separation plant having a main condenser.

13. The apparatus of claim 12 wherein the liquid is removed from the first cryogenic rectification system at the area of the main condenser.

14. The apparatus of claim 9 wherein the second cryogenic rectification system comprises a double column air separation plant having a main condenser.

15. The apparatus of claim 14 wherein the liquid is provided into the second cryogenic rectification system at the are of the main condenser.

16. The apparatus of claim 9 wherein the means to provide liquid from the first cryogenic rectification system into the second cryogenic rectification system comprises conduit means and collection means.

17. The apparatus of claim 9 wherein the means to provide liquid from the first cryogenic rectification system into the second cryogenic rectification system comprises trucking means.

18. The apparatus of claim 9 wherein the means to provide liquid from the first cryogenic rectification system into the second cryogenic rectification system comprises conduit means in flow communication with both the first cryogenic rectification system and the second cryogenic rectification system.

19. The apparatus of claim 9 further comprising means to provide liquid from the second cryogenic rectification system into the first cryogenic rectification system.

* * * * *